United States Patent [19]

Stark

[11] Patent Number: 4,502,278

[45] Date of Patent: Mar. 5, 1985

[54] DIESEL EXHAUST CLEANER AND BURNER SYSTEM WITH MULTI-POINT IGNITERS

[75] Inventor: Terrence L. Stark, Washington, Mich.

[73] Assignee: General Motors Corporation, Detroit, Mich.

[21] Appl. No.: 555,052

[22] Filed: Nov. 25, 1983

[51] Int. Cl.[3] ..... F01N 3/02

[52] U.S. Cl. ..... 60/303; 55/466; 55/DIG. 10; 55/DIG. 30

[58] Field of Search ..... 60/286, 297, 303, 311; 55/466, DIG. 10, DIG. 30

[56] References Cited

U.S. PATENT DOCUMENTS 4,054,418 10/1977 Miller ..... 60/297

4,322,387 3/1982 Virk ..... 55/DIG. 30

*Primary Examiner*—Douglas Hart

*Attorney, Agent, or Firm*—Arthur N. Krein

[57] ABSTRACT

An exhaust cleaner and multi-point burner system for a diesel engine has a burner device with concentric first and second sets of circumferentially spaced apart point igniters facing the inlet end face of a particulate filter to effect multiple points of ignition of the particulates collected thereon, and a central point igniter to serve as a pilot light, supplied with an air/fuel mixture by a first supply conduit and a solenoid valve controlled supply conduit, respectively. The arrangement is such that the air/fuel mixture to the sets of point igniters is ignited using a single central electric igniter, such as a spark plug to ignite the air/fuel mixture supplied to the central igniter. Once all points are ignited, the solenoid valve is closed, thus increasing the flow of the air/fuel mixture to the sets of point igniters. This change in flow reduces heat losses and minimizes air/fuel requirements to effect ignition of the particulates.

2 Claims, 2 Drawing Figures

DIESEL EXHAUST CLEANER AND BURNER SYSTEM WITH MULTI-POINT IGNITERS

BACKGROUND OF THE INVENTION

This invention relates to diesel engine exhaust treatment systems, and, in particular, to an exhaust cleaner and burner system with multi-point igniters for use in collecting and then incinerating particulates discharged with the exhaust gases from a diesel engine.

DESCRIPTION OF THE PRIOR ART

It is known in the art to provide a diesel engine with an exhaust treatment system that includes one or more particulate traps or filters that are operative to filter out and collect particulates from the exhaust gas stream discharged from the engine. Such particulates consist largely of carbon particles that tend to plug the filter, thus restricting exhaust gas flow therethrough. Accordingly, after continued use of such a system for a period of time, dependent on engine operation, it becomes desirable to effect regeneration of the particulate filter.

Regeneration or restoration of such a particulate filter has been accomplished by the use of a suitable auxiliary burner device. For example, an air-fuel nozzle and an ignition device can be used and operated, when desired, to heat the exhaust gases and the particulate filter to the combustion temperature of the collected particulates so as to burn them off the filter surfaces and, accordingly, to thus reopen the flow paths therethrough to again permit normal flow of the exhaust gases through that filter.

However, such prior known burner devices, as used with ceramic wall flow particulate filters, have normally required the use of relatively large quantities of fuel to heat the incoming exhaust gases so as to effect the complete incineration of the particulates collected by this type filter, even when additives, such as lead or copper acetate, are added to the diesel fuel to effect a reduction in the ignition temperature of the particulates.

SUMMARY OF THE INVENTION

Accordingly, a primary object of the invention is to provide an improved exhaust cleaner and burner system for use with a diesel engine that advantageously utilizes multi-point igniters so as to direct the flame from a fuel burner to multiple points on the inlet face of a filter, such as a ceramic wall-flow filter, whereby the particulates are ignited at multiple points for advance to adjacent inlet channels of the filter whereby to provide for the complete regeneration of the filter.

Another object of the invention is to provide an improved exhaust cleaner and burner system with multi-point igniters for a diesel engine of the type wherein a ceramic wall-flow particulate trap is used to collect particulates and a fuel burner with multi-point igniters is used to ignite particulates on the inlet end of the filter to effect incineration of the particulates collected by the filter.

For a better understanding of the invention, as well as other objects and further features thereof, reference is had to the following detailed description of the invention to be read in connection with the accompanying drawings.

DESCRIPTION OF A PREFERRED EMBODIMENT

Figure 1:
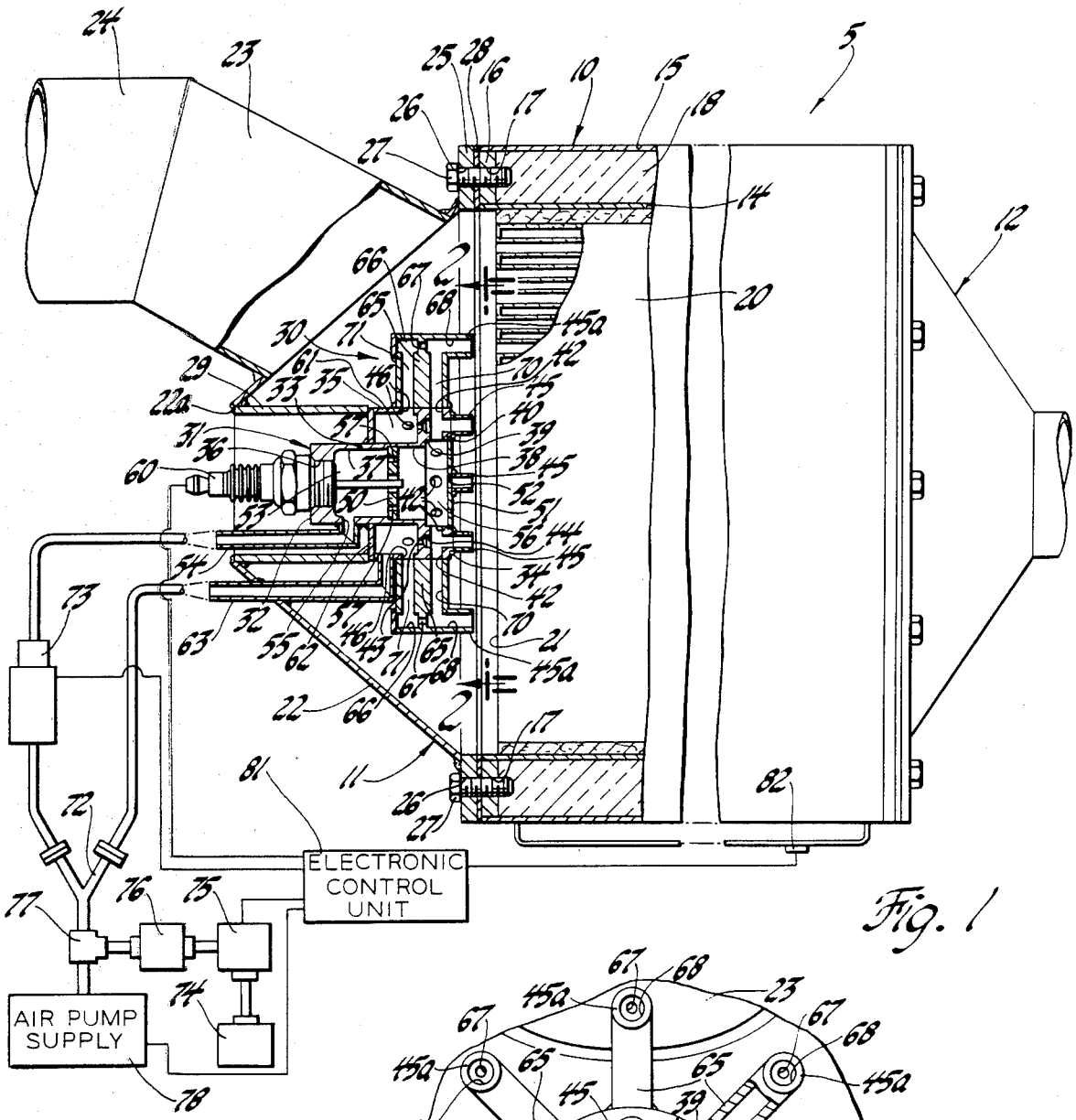
FIG. 1 is a schematic view, with parts broken away, of a diesel exhaust cleaner and burner system with multi-point igniters in accordance with a preferred embodiment of the invention.

Referring now to FIG. 1 there is illustrated a single path exhaust cleaner and burner system with multi-point igniters in accordance with the invention for use with a diesel engine.

The exhaust cleaner, generally designated 5, in the construction shown is provided with a tubular trap housing that includes a filter housing 10 having an exhaust inlet 11 at one end and an exhaust outlet 12 at its opposite end.

In the construction shown, the filter housing 10 includes an inner shell 14 and an outer shell 15 loosely encircling the inner shell 14, with the outer shell 15 suitably fixed, as by welding, at its opposite ends to a pair of ring-like flanges 16. Each flange 16 is provided with circumferentially spaced apart, internally threaded apertures 17, only the apertures 17 in the flange 16 at the inlet end of the filter housing being shown.

As shown, a suitable high temperature resistant, thermal insulating material 18 is loosely sandwiched between the inner and outer shells 14 and 15, respectively, along their axial extent between the flanges 16.

A ceramic wall-flow monolith particulate filter 20, of the type shown, for example, in U.S. Pat. No. 4,364,761, entitled "Ceramic Filters for Diesel Exhaust Particulates and Methods of Making", issued Dec. 21, 1982 to Morris Berg, Carl F. Schaefer and William J. Johnston, or in U.S. patent application Ser. No. 495,579, entitled "Wall-Flow Monolith Filter with Porous Plugs", filed May 18, 1983 in the names of David L. Dimick, Kenneth B. Bly and Otto A. Ludecke, is suitably supported in a known manner within the inner shell 14 of the filter housing 10 with its inlet end face 21 located a predetermined axial distance from the outboard face of the flange 16 at the inlet end of the filter housing.

As is well known, the filter can be of circular configuration, as in the embodiment shown, or it can be, for example, of oval configuration, it being realized, of course, that the housing 10 would have a conforming configuration.

Referring now to the exhaust inlet 11, in the construction shown, this exhaust inlet, starting from the right with reference to FIG. 1, includes a tubular transition member 22 having an outlet end portion corresponding in size to that of inner shell 14, an angled intermediate duct member 23 and an inlet passage 24, these elements being suitably secured together, as by welding, into a unitary structure. The transition member 22 at its outlet end, the right hand end with reference to FIG. 1, is suitably secured, as by welding, to a ring-like mounting flange 25 having circumferentially spaced apart screw receiving apertures 26 therethrough whereby the exhaust inlet 11 is secured to the filter housing 10, as by screws 27 which extend through the apertures 26 for threaded engagement in the apertures 17. As would be conventional, a gasket 28 is sandwiched between the flanges 16 and 25.

With the arrangement of the exhaust inlet 11 shown, its inlet passage 24, which is adapted to be connected so as to receive the exhaust gases discharged from a diesel engine, not shown, is radially offset from the longitudinal axis of the filter housing 10, whereby a burner device with multi-point igniters, to be described in detail next hereinafter, can be mounted in and to the transition member 22. For this purpose, the transition member 22 has a circular opening 22*a* at its free end with an annular boss 29, of predetermined axial extent, positioned therein and secured, as by welding, to the transition member 22 whereby the opposite end of the boss 29 extends toward the filter 20.

The burner device with multi-point igniter, generally designated 30, in accordance with the invention, includes a burner body 31 which, in the construction illustrated, was machined so as to be of tubular configuration with a base 32 having an annular shell 33 extending therefrom to terminate at an outward extending radial flange portion 34 that in turn has an annular outer shell 35 extending therefrom a predetermined distance back toward the base 32, for a purpose to be described in detail hereinafter.

In the construction illustrated, the burner body 31 is provided with a through stepped bore so as to define an internally threaded wall 36 extending through base 32, stepped intermediate walls 37, 38 and 39 and an end wall 40.

The flange portion 34 of the burner body 31 is provided with a plurality of circumferentially, equally spaced apart radial through bores, each such bore defining a flow passage 42 that extends from bore wall 39 radially outward to break through the outer peripheral surface of the flange portion 34. In the embodiment shown in FIGS. 1 and 2, eight such flow passages 42 are provided.

In addition, this flange portion 34 of the burner body 31, radially inward of outer shell 35, is provided with a plurality of circumferentially spaced apart, axial extending through bores with each such bore defining an orifice passage 43 and a discharge passage 44, the latter intersecting an associate flow passage 42. In the construction shown, four such axial bores are provided and these bores are circumferentially spaced so that they intersect only alternate ones of said flow passages 42. The outlet end, the right hand end with reference to FIG. 1, of each discharge passage 44 is encircled by a tubular burner tip or point igniter 45 that is suitably secured to the flange portion 35, as by welding.

Outer shell 33 is also provided with a plurality of ports 46, corresponding in number to the number of flow passages 42 with each of these ports 46 being aligned with and in spaced apart relationship to an associate flow passage 42.

As best seen in FIG. 1, an igniter hole plate 50 is suitably secured within the shell 33 as by being positioned in abutment against the shoulder interconnecting walls 37 and 38. A cover plate 51, with a central discharge passage 52 therethrough, is positioned in end wall 40 so as to abut against the shoulder interconnecting walls 39 and 40 and is secured to the burner housing, as by welding. A tubular burner tip or point igniter 45 is welded to the cover plate 51 so as to encircle the discharge passage 52. In a manner to be described in detail hereinafter, this coaxial or center point igniter 45 operates, in effect, as a pilot light.

With the arrangement shown, base 32 together with the wall 37 and one side of the igniter hole plate 50 defines a secondary supply chamber 53 which is supplied with a suitable air fuel mixture via an inlet conduit 54 that is suitably secured as by welding so as to be in flow communication with an inlet port 55 provided for this purpose in the shell 33. The opposite side of the igniter hole plate 50 together with the walls 38 and 39 and cover plate 51 defines a combustion chamber 56 that is in flow communication with the secondary supply chamber via the circumferentially spaced apart apertures 57 provided in the igniter hole plate 50.

To effect ignition of the combustible mixture flowing into the combustion chamber 56, a suitable electric igniter, such as a spark plug 60, is threadingly received in the internally threaded wall 36 of base 32 whereby its tip end extends through a central aperture in the igniter hole plate 50 into the combustion chamber 56. The opposite end of the spark plug 60 is thus suitably positioned so as to be connected to a source of electrical power, as controlled for example, by an onboard computer.

A primary supply chamber 61 is defined in part via the internal surface of the outer shell 35, the inboard end of the flange portion 34, a portion of the exterior surface of the shell 33 and by the inner surface of a ring closure plate 62 that is secured at its opposite end, as by welding to the shells 33 and 35 of the burner body 31. As best seen in FIG. 1, the ring closure plate 62 is also secured, as by welding, to the boss 29 so as to be positioned within the transition member 22.

The primary supply chamber 61 is supplied with a combustible mixture of air and fuel as by a conduit 63 that is secured, as by welding, to be in flow communication with the supply chamber. As shown in FIG. 1, the opposite end of this conduit 63 extends through a suitable opening provided for this purpose in the transition member 22 and is preferably sealingly secured thereto as by welding.

Figure 2:
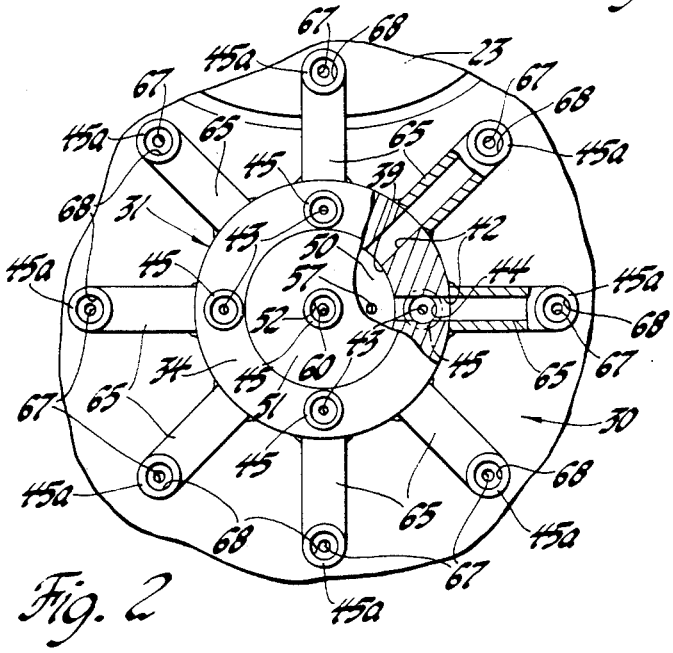
FIG. 2 is a cross-sectional view of the fuel burner with multi-point igniters, per se, taken along line 2—2 of FIG. 1.

As shown in FIGS. 1 and 2, a plurality of igniter arms 65, corresponding in number to the number of flow passages 42, are suitably secured, as by welding, to the flange portion 34 of the burner body 31 so as to overlie the aligned associated flow passages 42 and ports 46. Each such igniter arms 65 is provided at its outer free end with a stepped bore to define a chamber 66, an orifice passage 67 and a discharge passage 68 that extends through a tubular point igniter 45*a* which, in the embodiment shown is formed integral with its associate igniter arm. In addition, each igniter arm 65 is provided with spaced apart flow passages 70 and 71 aligned at one end substantially coaxial with an associate flow passage 42 and port 46, respectively and at their other ends opening into the discharge passage 68 and chamber 66, respectively.

Thus, as best seen in FIG. 2, the burner device 30 with multi-point igniters is provided with a central point igniter 45, and with inner and outer rings of point igniters 45 and 45*a* encircling the central igniter 45. As shown in FIG. 1, all of these igniters extend axially toward the inlet face 21 of the particulate filter 20 and are spaced from this inlet face 21 by a predetermined distance so that during operation of the burner device, flames from these igniters will directly impinge upon the inlet end face of the filter.

As schematically shown in FIG. 1, the conduits 54 and 63 are supplied with a suitable air/fuel mixture from a common supply via, for example, a Y fitting 72, with flow through the conduit 54 being controlled by a normally open solenoid valve 73, for a purpose to be described hereinafter.

The burner device 30 can be supplied with any suitable fuel and, in the embodiment schematically illustrated in FIG. 1, it is supplied with propane from a conventional and commercially available canister 74 of pressurized propane. The canister 74 is connected via a normally closed solenoid actuated on-off valve 75 to the inlet of a pressure regulator 76 which has its outlet suitably connected to the leg of an air/fuel orificed mixing tee 77.

In the embodiment shown, a small volume of air is supplied to the burner device 30 by means of a conventional air pump, such as electric air pump 78, which is suitably connected to a side branch of the mixing tee 77. As will be apparent, the other branch of the mixing tee 77 is connected to the common end of the Y fitting 72.

In the embodiment shown in FIG. 1, the electric air pump 78, the solenoid valves 73 and 75 and the electric igniter 60 are suitably connected to a source of electric power as controlled by means of an electronic control unit 81, such as an onboard computer, in a manner well known in the art.

For this purpose, the electronic control unit 81, in a conventional manner, receives input signals of various engine operating conditions and, in addition, it would preferably also receive a suitable signal indicating the operational condition of the filter 20, as for example, the pressure differential existing across the particulate filter 20 during engine operation. This pressure differential is sensed by a suitable pressure differential gauge 82 operatively connected for communication with the inlet and outlet ends of the filter whereby to measure the pressure drop across the filter.

Preferably the system is programmed so that when a regeneration cycle is to be initiated, the solenoid valves 75 and 73 are opened and the air pump 78 is energized so that an air/fuel mixture can be supplied via the conduits 54 and 63 to the secondary amd primary supply chambers 53 and 61 respectively and the spark plug is then energized. As this occurs, the combustible air/fuel mixture flowing into the supply chamber 53 and through the igniter hole plate 50 into the combustion chamber 56 will be ignited therein by the spark plug 60. As this occurs, a flame will be discharged out through the central igniter 45 against the inlet end face 21 of the filter 20. At the same time the air/fuel mixture entering the primary supply chamber 61 will flow therefrom via the orifice passage 43 into the inner circle of point igniters 45 and it will also flow via the flow passages 71 and orifice passage 67 into the outer ring of igniters **45*a* where it will be ignited via the flame from the central igniter 45 or from the combustion flame in the combustion chamber 56 whereby the jets of flame will be discharged from these point igniters toward the inlet end face of the filter 20. In effect, the combustion mixture burning within the combustion chamber 56 and that discharged from the central point igniter 45** is operational in a manner similar to that of a pilot light, as for example, on a gas stove.

After a predetermined short period of time, the solenoid 73 is actuated to its closed position so as to prevent further flow of the air/fuel mixture through the conduit 54 and of course the spark plug 60 is also deenergized so that thereafter the air/fuel mixture is only supplied via the primary supply chamber 61 to the inner and outer rings of point igniters 45 and **45*a*. Upon a complete combustion of the air/fuel mixture in the combustion chamber 56 after closure of the solenoid valve 73, a flame will no longer be discharged through the central igniter 45**.

Thereafter, as either a function of time or of an operating condition of the filter, the solenoid valve 75 is actuated to its closed position. Preferably the air pump 78 is operated continuously to supply air to the burner device 30 to keep particulates from collecting in the orifice passages leading to the inner and outer rings of igniters 45 and **45*a* and to keep the spark plug 60** clean.

With the arrangement shown, the air/fuel mixture supplied to the plural igniters, 12 individual igniters in the embodiment shown, is ignited using a single central spark plug 60. As disclosed the air/fuel mixture initially flows through both conduits 54 and 63 but, once all points of exit flow of the combustion mixture from the inner and outer ring of igniters 45 and **45*a* are ignited, the flow through conduit 54 is turned off by means of the solenoid valve 73. This results in an increase in flow of the air/fuel mixture to the inner and outer rings of igniters 45 and 45*a*** with a resulting increase in the size of the flame projected out of each point igniter.

The burner device with multi-point igniters in accordance with the invention is thus operative to effect ignition of particulates collected on a filter with a minimum of heat losses and, accordingly, is operative with minimum air/fuel requirements for a given exhaust filter application.

Less fuel is required, since after initial light off, combustion of fuel in the combustion chamber 56 which is at a location remote from the inlet end face of the filter is terminated upon closure of the solenoid valve 73, and thereafter, all fuel supplied to the burner device 30 is consumed in the flames at the point igniters 45, **45*a*** which directs these flames directly against points on the inlet end face of the filter.

It will be appreciated that the time interval during which the burner device is operated can vary as a function of a particular engine-filter application and the fuel used in the engine. In regard to the latter, for example, when a fuel additive such as Pb-TEL, Cu-Acetate or a similar additive is used in the diesel fuel, the particulate incineration is merely initiated by use of the subject burner device with multi-point igniters and then completed by the propagation of burn due to the presence of the fuel additive which acts like a chimney sweep catalyst to promote complete regeneration of the filter without the need to divert exhaust gases from the filter during such regeneration cycle.

Thus in a particular embodiment of a burner device with multi-point igniters as used on both 4.3 liter diesel and 6.2 liter diesel engines equipped with ceramic monolith filters, the burner device was operated from 10 to 20 seconds maximum for each regeneration cycle.

While the invention has been described with reference to the structure disclosed herein, it is not confined to the details set forth, and this application is intended to cover such modifications or changes as may come within the purposes of the improvements or the scope of the following claims.

The embodiments of the invention in which an exclusive property or privilege is claimed are defined as follows:

1. An exhaust cleaner and multi-point discharge burner system for use with a diesel engine, said system including a trap housing having an inlet at one end for receiving exhaust gas and an exhaust outlet at its opposite end; a filter means operatively positioned in said trap housing intermediate said inlet and said exhaust outlet and having an inlet end face axially spaced from said inlet; and, a multi-point discharge, fuel burner means operatively positioned in said inlet, said fuel burner means including a burner housing means having a supply chamber at one end with a solenoid valve controlled air/fuel inlet in flow communication therewith and a combustion chamber at its opposite end in flow communication with said supply chamber, a central point igniter extending axially from said combustion chamber to terminate at its other end in closely spaced apart relationship to said inlet end face, a plurality of flow passages extending radially outward from said combustion chamber; an igniter means operatively positioned in said burner housing means for effecting ignition of an air/fuel mixture in said combustion chamber; a second burner housing means encircling said burner housing and having a second supply chamber therein and an air/fuel inlet in flow communication therewith, said second burner housing having a first set of circumferentially spaced apart flame discharge tubes encircling said central point igniter and a second set of circumferential spaced apart flame discharge tubes encircling said first set of said flame discharge tubes and in flow communication with said second supply chamber and with said flow passages, said first and second sets of flame discharge tubes extending from the opposite end of said second burner housing means axially toward said inlet face.

2. An exhaust cleaner and multi-point discharge burner system for use with a diesel engine, said system including a housing having an inlet at one end for receiving exhaust gas from an engine and an exhaust outlet at its opposite end; a filter means operatively positioned in said housing intermediate said inlet and said exhaust outlet and having an inlet face axially spaced from said inlet; and, a multi-point discharge, fuel burner means operatively positioned in said inlet, said fuel burner means including a burner housing means defining a supply chamber with a solenoid valve controlled air/fuel inlet thereto at one end thereof, a combustion chamber at its opposite end with a number of circumferentially spaced apart flow passages extending radially therefrom, and a central point igniter extending axially therefrom, an igniter means operatively positioned in said burner housing means to effect ignition of an air/fuel mixture in said combustion chamber; said fuel burner means further including a second burner housing encircling said burner housing means defining a second supply chamber with an air/fuel inlet thereto, a first and second sets of circumferentially spaced apart point igniters concentrically positioned about said central point igniter in flow communication at one end with said flow passages and said second supply chamber and at their other ends extending axially toward said inlet end face of said filter.

* * * * *